US010134526B2

(12) United States Patent
Brooksbank

(10) Patent No.: US 10,134,526 B2
(45) Date of Patent: Nov. 20, 2018

(54) SHEET FORMED INDUCTIVE WINDING

(71) Applicant: DISH Technologies L.L.C., Englewood, CO (US)

(72) Inventor: John Nicholas Brooksbank, West Yorkshire (GB)

(73) Assignee: DISH Technologies L.L.C., Englewood, CO (US)

( * ) Notice: Subject to any disclaimer, the term of this patent is extended or adjusted under 35 U.S.C. 154(b) by 350 days.

(21) Appl. No.: 15/055,908

(22) Filed: Feb. 29, 2016

(65) Prior Publication Data

US 2016/0181015 A1 Jun. 23, 2016

Related U.S. Application Data

(62) Division of application No. 14/201,570, filed on Mar. 7, 2014, now Pat. No. 9,312,067.
(Continued)

(51) Int. Cl.
*H01F 41/04* (2006.01)
*H01F 41/10* (2006.01)
(Continued)

(52) U.S. Cl.
CPC ..... *H01F 41/041* (2013.01); *H01F 17/062* (2013.01); *H01F 27/2804* (2013.01);
(Continued)

(58) Field of Classification Search
CPC ..... Y10T 29/4902; Y10T 29/49071; Y10T 29/49073; H01F 17/0006; H01F 17/0033; H01F 17/06; H01F 17/062; H01F 2017/0046; H01F 2017/0076; H01F 27/2804; H01F 27/2852; H01F 27/2895; H01F 27/292; H01F 27/306;
(Continued)

(56) References Cited

U.S. PATENT DOCUMENTS 3,287,795 A 11/1966 Chambers et al.
4,536,733 A 8/1985 Shelly
(Continued)

FOREIGN PATENT DOCUMENTS

WO 2006/063081 A2 6/2006
WO 2014/140187 A1 9/2014

OTHER PUBLICATIONS

International Search Report and Written Opinion for PCT/EP2014/054977, dated May 8, 2014, 12 pages.
U.S. Appl. No. 14/201,570, filed Mar. 7, 2014, Non-Final Rejection dated Mar. 24, 2015, 17 pages.
U.S. Appl. No. 14/201,570, filed Mar. 7, 2014, Final Rejection dated Sep. 4, 2015, 13 pages.
U.S. Appl. No. 14/201,570, filed Mar. 7, 2014, Non-Final Rejection dated Oct. 22, 2015, 15 pages.
U.S. Appl. No. 14/201,570, filed Mar. 7, 2014, Non-Final Rejection dated Dec. 22, 2015, 12 pages.
U.S. Appl. No. 14/201,570, filed Mar. 7, 2014, Notice of Allowance dated Feb. 8, 2016, 19 pages.
(Continued)

*Primary Examiner* — Peter DungBa Vo
*Assistant Examiner* — Joshua D Anderson
(74) *Attorney, Agent, or Firm* — Kilpatrick Townsend & Stockton LLP

(57) ABSTRACT

Systems and methods for creating an inductive element are disclosed. Multiple partial windings may be created relative to a core, where each of the partial windings is initially discontinuous. Multiple printed conductors may be created on a substrate, where the multiple printed conductors are arranged to electrically connect the multiple partial windings. The multiple partial windings may be electrically connected to the multiple printed conductors to create a complete winding around the core.

11 Claims, 15 Drawing Sheets

Related U.S. Application Data

(60) Provisional application No. 61/790,611, filed on Mar. 15, 2013.

(51) Int. Cl.
*H01F 27/28* (2006.01)
*H01F 27/30* (2006.01)
*H01F 17/06* (2006.01)

(52) U.S. Cl.
CPC ..... *H01F 27/2847* (2013.01); *H01F 27/306* (2013.01); *H01F 41/10* (2013.01); *H01F 2027/2814* (2013.01); *Y10T 29/49073* (2015.01)

(58) Field of Classification Search
CPC ..... H01F 2027/065; H01F 2027/2814; H01F 2027/2819; H01F 2027/2847; H01F 2027/297; H01F 41/04; H01F 41/041; H01F 41/0476; H01F 41/06; H01F 41/061; H01F 41/10; H01F 41/08
See application file for complete search history.

(56) References Cited

U.S. PATENT DOCUMENTS

| | | | | |
|---|---|---|---|---|
| 7,477,128 | B2 | 1/2009 | Quilici | |
| 9,312,067 | B2 | 4/2016 | Brooksbank | |
| 2003/0025585 | A1* | 2/2003 | Macerini | H01F 27/2804 336/65 |
| 2004/0130428 | A1 | 7/2004 | Mignano et al. | |
| 2008/0186124 | A1* | 8/2008 | Schaffer | H01F 17/0033 7/33 |
| 2011/0001590 | A1 | 1/2011 | Wu et al. | |
| 2011/0084789 | A1 | 4/2011 | Park et al. | |
| 2012/0146755 | A1 | 6/2012 | Shao | |
| 2014/0266548 | A1 | 9/2014 | Brooksbank | |

* cited by examiner

SHEET FORMED INDUCTIVE WINDING

CROSS-REFERENCE TO RELATED APPLICATION

This Application is a divisional of U.S. nonprovisional application Ser. No. 14/201,570, filed Mar. 7, 2014, entitled "SHEET FORMED INDUCTIVE WINDING," which claims priority to U.S. provisional application 61/790,611, filed Mar. 15, 2013, entitled "SHEET FORMED INDUCTIVE WINDING," the entire disclosure of which is hereby incorporated by reference for all purposes.

BACKGROUND

The present disclosure relates in general to inductors, and, more specifically, but not by way of limitation, to sheet formed inductive winding.

In a typical Universal Serial Bus (USB) power circuit, a single voltage source supplies voltage to multiple USB outputs. As such, if USB devices are connected with the multiple USB outputs, each of these USB devices are drawing current from the same voltage source. While an ideal voltage source may be able to always output a constant voltage, real world voltage sources cannot output an ideal constant voltage at least when the load connected with the voltage source changes rapidly.

For example, if a first USB device is connected with a first USB power output and is receiving current from the voltage source, the overall load connected with the voltage source may change when a second USB device is connected with another USB power output. This increase in load may result from the second USB device drawing current from the same voltage source. Upon initial connection to a USB power output, the second USB device may draw an inrush current due to components (e.g., capacitors) requiring initial charging, thus resulting in a transient electrical load on the voltage source. Due to the transient load caused by the second USB device being connected to the second USB power output, the voltage supplied to the first USB device may "droop." Such droop refers to a temporary decrease in the provided voltage. Such a temporary decrease in output voltage may affect the performance of the first USB device and/or may violate a defined standard that specifies a minimum voltage that a USB device should be supplied.

There is a need for solutions to address such a problem and related problems in space-constrained implementations in manners suitable for low-cost, high-volume manufacturing processes.

BRIEF SUMMARY

Certain embodiments of the present disclosure relate in general to inductors, and, more specifically, but not by way of limitation, to sheet formed inductive winding.

In one aspect, a method for forming an inductive element is disclosed. Multiple partial windings may be disposed at least partially about a core such that the multiple partial windings are electrically disconnected. Multiple conductors coupled to a substrate may be arranged to electrically connect the multiple partial windings. The multiple partial windings may be electrically connected to the multiple conductors to form an electrically continuous winding about the core.

In some embodiments, two tabs for each partial winding of the multiple partial windings may be formed. Electrically connecting the multiple partial windings to the multiple conductors to form the electrically continuous winding about the core may include attaching the two tabs of each partial winding of the multiple windings to different conductors of the multiple conductors. In some embodiments, electrically connecting the multiple partial windings to the multiple conductors to form the electrically continuous winding about the core may include: passing each partial winding of the multiple partial windings partially through the substrate for mounting; and mounting each of the multiple partial windings to the substrate.

In some embodiments, a well in the substrate may be created sufficient to depress the core a distance into the substrate, and the core may be attached to the substrate within the well such that the core is depressed the distance into the substrate. In some embodiments, the multiple conductors may be printed conductors. In some embodiments, at least two terminals for the inductive element may be formed, and the at least two terminals may be couple with other components. In some embodiments, the inductive element may be a dedicated inductor component having two terminals. In some embodiments, the inductive element may be a dedicated transformer component having three or more terminals. In some embodiments, the core may be attached to the substrate. In some embodiments, the core may be toroidal. In some embodiments, the multiple partial windings may be formed from a sheet of malleable conductive material. In some embodiments, the multiple partial windings may be formed at least in part with the core.

In another aspect, an inductive device is disclosed. The inductive device may include a core, a plurality of partial windings disposed at least partially about the core, and a plurality of conductors coupled to a substrate. Each conductor of the plurality of conductors may be electrically connected with two partial windings of the plurality of partial windings to form an electrically continuous winding about the core.

In some embodiments, the plurality of partial windings and the plurality of conductors may be arranged in a separate winding configuration. In some embodiments, the plurality of partial windings and the plurality of conductors may be arranged in an interleaved winding configuration. In some embodiments, the plurality of partial windings and the plurality of conductors may be arranged in an asymmetric winding configuration. In some embodiments, at least two terminals may be formed for the electrically continuous winding.

In yet another aspect, a device configured to be manufactured into an inductive device is disclosed. The device may include a core and a plurality of partial windings. Each partial winding of the plurality of partial windings may be electrically isolated from each other. Each partial winding of the plurality of partial windings may be configured to be connected into a continuous winding via printed conductors on a substrate.

In some embodiments, the device may further include a plurality of tabs. Each partial winding may be attached to two tabs of the plurality of tabs. Each tab of the plurality of tabs may be attached to a printed conductor. In some embodiments, each partial winding of the plurality of partial windings may be further configured to pass at least partially through the substrate for mounting.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. When only the first reference label is used in the specification, the description is applicable to any one of the similar components having the same first reference label irrespective of the second reference label.

DETAILED DESCRIPTION

Figure 1:
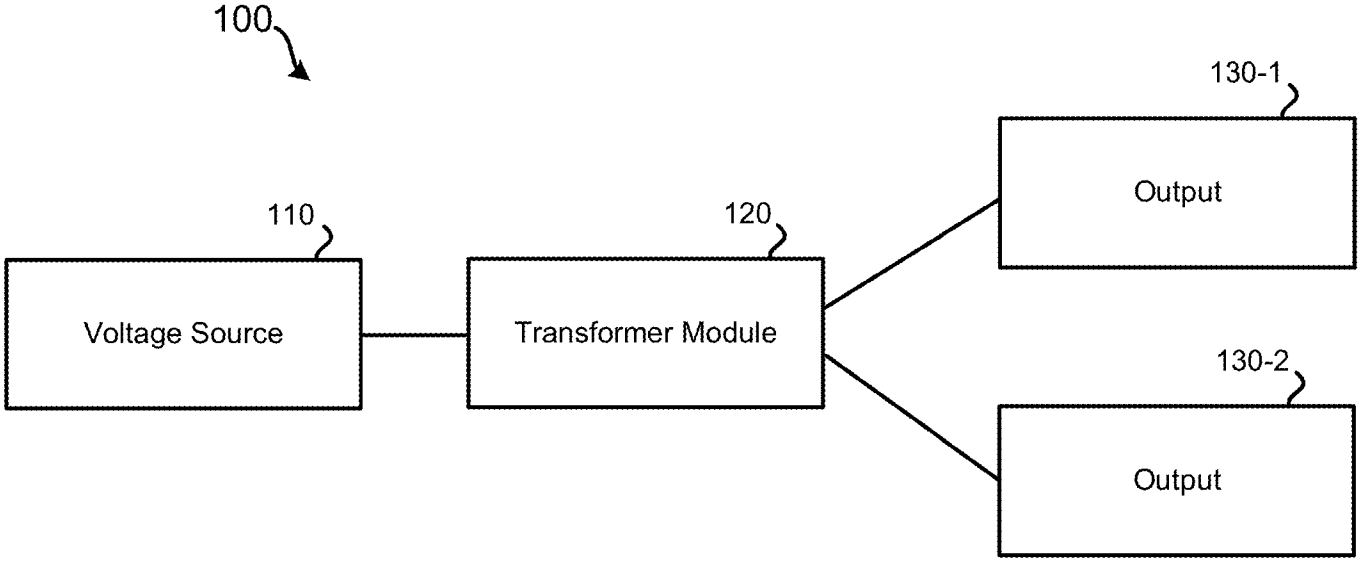
FIG. 1 illustrates a block diagram of an embodiment of a system for mitigating voltage droop in a direct current circuit configured to power multiple time variant loads, such as capacitive loads, in accordance with certain embodiments of the present disclosure.

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment of the disclosure. It should be understood that various changes may be made in the function and arrangement of elements without departing from the spirit and scope of the disclosure as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Certain embodiments according to the present disclosure may provide for transient electrical load decoupling for a direct current power supply. Certain embodiments may provide for inductor windings created using shaped conductive sheets and PCB/PWB traces to complete the windings of the inductor. Certain embodiments may provide for inductor windings created using shaped conductive sheets.

As discussed above, in a typical USB power circuit, a single voltage source supplies voltage to multiple USB outputs and voltage droop may be a problem. Typically, in order to decrease such droop when a second USB device is coupled with the same voltage source, each USB power output may be connected with some number of capacitors. Such capacitors may help reduce the amount of voltage droop when the load on the voltage source is increased by supplying current when the voltage output by the voltage source decreases. In a typical arrangement, each USB power output may be connected with a substantial number of capacitors, such as eight 10 microfarad capacitors, a 100 microfarad capacitor, and a 0.1 microfarad capacitor.

Use of such numbers of capacitors may have drawbacks. For example, if a large number of capacitors are used, the cost associated with acquiring the capacitors may be substantial, especially if a large number of circuits containing the USB power circuit are being manufactured. Further, the more capacitors used, the more circuit board space that is occupied and unavailable for other components. As such, a circuit board may need to be enlarged to accommodate all of the capacitors and/or other components may not be added to the circuit board because of the space needed for the capacitors. In a first aspect, embodiments detailed herein may reduce or remove the requirement for some or all electric energy storage devices (e.g. capacitors) conventionally used to maintain stable DC voltage supplies for distributed systems that present transient load changes, replacing them with magnetic energy storage. The stability of DC electric energy distributed to two or more switched or variable (transient) loads is conventionally improved with capacitors. Embodiments herein use magnetic energy storage (e.g., transformers) to replace electric energy storage devices.

Decreasing the number of capacitors used for decoupling transient electrical loads when a USB device is initially connected with a USB power supply may be desired. Decreasing the number of capacitors used for decoupling the transient electrical load for a USB power supply may free circuit board space and/or save money and manufacturing costs by decreasing the number of parts that need to be installed on a circuit board containing the USB power circuit.

Rather than using (only) capacitors to decrease voltage droop when a USB device is initially coupled with a USB power supply, a transformer may be used. The transformer may be used in conjunction with fewer, or possibly without, capacitors to counteract voltage droop due to coupling between USB power outputs. The use of the transformer may allow for the voltage to be increased on a first output when an increased amount of current is supplied to a second output, such as when the second output is initially connected with a capacitive load. In such an arrangement, each output may be coupled with a different winding of the transformer. As such, upon the capacitive load being connected with the second output, an inrush current may be supplied to the second output. In some instances, the capacitive load may draw a significant inrush current because, for instance, it may contain some number of capacitors that require charging from an uncharged state. The inrush current being supplied to the second output may result in an increase in the voltage supplied to the first output (that is, an increase over the amount of voltage that would be supplied if the transformer was not present) due to the magnetic flux induced in the transformer by the inrush current.

The use of such a transformer may sufficiently counteract voltage droop to satisfy one or more USB standards for powering a USB device and allowing no more than a 330 mV voltage droop. As such, a transformer may be used instead of some or all of the capacitors that would typically be used in a USB power circuit to decouple capacitive loads connected to the same voltage source. It should be understood that while the following description makes reference to a USB power circuit, similar embodiments may be used to counteract voltage droop on other direct current (DC) circuits.

FIG. 1 illustrates a block diagram of an embodiment of a system 100 for mitigating voltage droop in a direct current circuit configured to power multiple time variant loads, such as capacitive loads. Time variant loads may have an initialization current greater than the long-term average current. Examples may include incandescent lamps (metal filament) and electric motors. System 100 may include: voltage source 110, transformer module 120, and outputs 130.

Voltage source 110 may output a direct current (DC) voltage. This DC voltage may be generated using some other DC voltage or an AC voltage. Ideally, the DC voltage output by voltage source 110 remains at an ideal fixed voltage level, such as +5 V DC. As such, if the voltage source 110 is ideal, a rapid increase in load placed on the output to voltage source 110 would not affect the voltage level output by voltage source 110. However, a real-world voltage source may not be able to instantaneously adjust to changes in the load coupled with the output of the voltage source. As such, if a capacitive load is coupled with the output of voltage source 110, the DC voltage level output by voltage source 110 may decrease for a period of time when the capacitive load is drawing an initial inrush current. This decrease in output voltage level may be referred to as voltage "droop." In order to mitigate the amount of voltage droop when a capacitive load is coupled with voltage source 110, transformer module 120 may be coupled between voltage source 110 and outputs 130.

Transformer module 120 may comprise a tapped single-winding transformer or a dual-winding transformer. Transformer module 120 may be coupled between voltage source 110 and outputs 130 such that if one of outputs 130 draws an increased amount of current (such as due to an inrush current), the voltage supplied to the other output will have less voltage droop than if transformer module 120 was not present. This may be due to the magnetic flux induced by the inrush current in a first winding of the transformer causing an increase in voltage on the other winding of the transformer (in a dual winding transformer).

Transformer module 120 may be electrically coupled with outputs 130. Output 130-1 and output 130-2 may both use voltage source 110 as a power source. Ideally, output 130-1 and output 130-2 would be completely decoupled, such that a change in load on one output of outputs 130 does not affect the other output of outputs 130. As such, a change to the capacitive load on output 130-1 may affect the voltage received by output 130-2. Similarly, a change to the capacitive load on output 130-2 may affect the voltage received by output 130-1. If system 100 is a USB power supply, outputs 130 may represent USB ports to which USB devices may be connected and disconnected while the USB power supply is powered on. These USB devices may receive some or all of their power from the USB power supply. Each of these USB devices may be modeled as a capacitive load. As such, when initially connected to one of outputs 130, each USB device may draw an inrush current, such as to charge capacitive components (such as capacitors) within the USB device.

Figure 2:
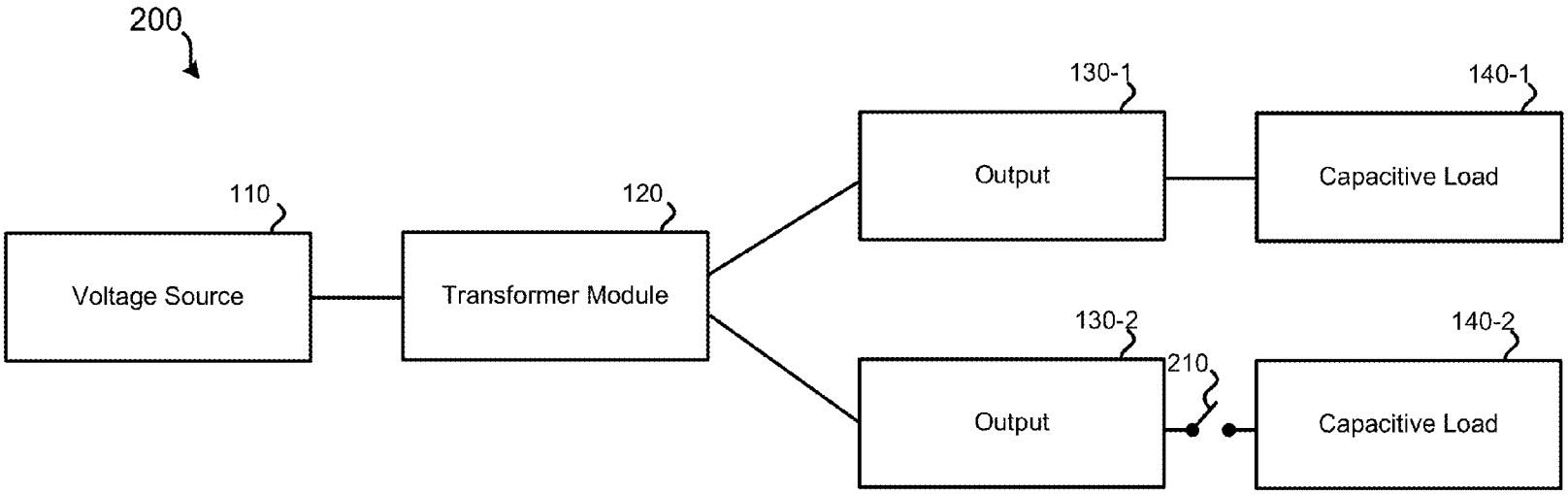
FIG. 2 illustrates a block diagram of an embodiment of a system for mitigating voltage droop in a direct current circuit configured to power multiple capacitive loads, in accordance with certain embodiments of the present disclosure.

FIG. 2 illustrates a block diagram of an embodiment of a system 200 for mitigating voltage droop in a direct current circuit configured to power multiple capacitive loads. System 200 represents system 100 in which a capacitive load 140-1 connected with output 130-1 and a capacitive load 140-2 that is connected with output 130-2 at a time after output 130-1 was connected with capacitive load 140-1.

In the illustrated embodiment of system 200, capacitive load 140-1 is connected with output 130-1. As such, voltage source 110 supplies a voltage that serves as the power supply to capacitive load 140-1 via transformer module 120 and output 130-1. Ideally, the direct current voltage received by capacitive load 140-1 from voltage source 110 would remain constant, with no voltage droop when capacitive load 140-2 is connected with output 130-2 (that is, capacitive load 140-1 and 140-2 would be completely decoupled). Capacitive load 140-2 is initially disconnected from voltage source 110 as indicated by switch 210 being open. While switch 210 may be used to connect and disconnect capacitive load 140-2 from 20 output 130-2, switch 210 may also represent other situations where capacitive load 140-2 may be disconnected from output 130-2 and may be subsequently connected. For example, a USB device that is initially disconnected may be physically plugged into a USB port while the USB power system is operating and, possibly, powering one or more other USB devices.

When switch 210 is closed (or capacitive load 140-2 is otherwise connected with 25 output 130-2), capacitive load 140-2 may draw an initial inrush current from voltage source 110 via transformer module 120 and output 130-2. Drawing this initial inrush current may result in the voltage provided to capacitive load 140-1 via transformer module 120 and output 130-1 temporarily drooping. The amount of voltage droop experienced by capacitive load 140-1 may be mitigated by transformer module 120. Transformer module 120 may be 30 configured such that when a current is drawn by capacitive load 140-2, the magnetic flux induced by the current drawn by capacitive load 140-2 results in additional voltage being provided to capacitive load 140-1, thus mitigating the voltage droop caused by the increased load on voltage source 110. While system 200 shows capacitive load 140-1 continuously coupled with output 130-1 and capacitive load 140-2 initially disconnected from output 130-2, it should be understood that the situation may be reversed. As such, capacitive load 140-2 may initially be coupled with output 130-2; capacitive load 140-1 may then be connected with output 130-5 while capacitive load 140-2 is using voltage source 110 as its supply voltage.

Figure 3:
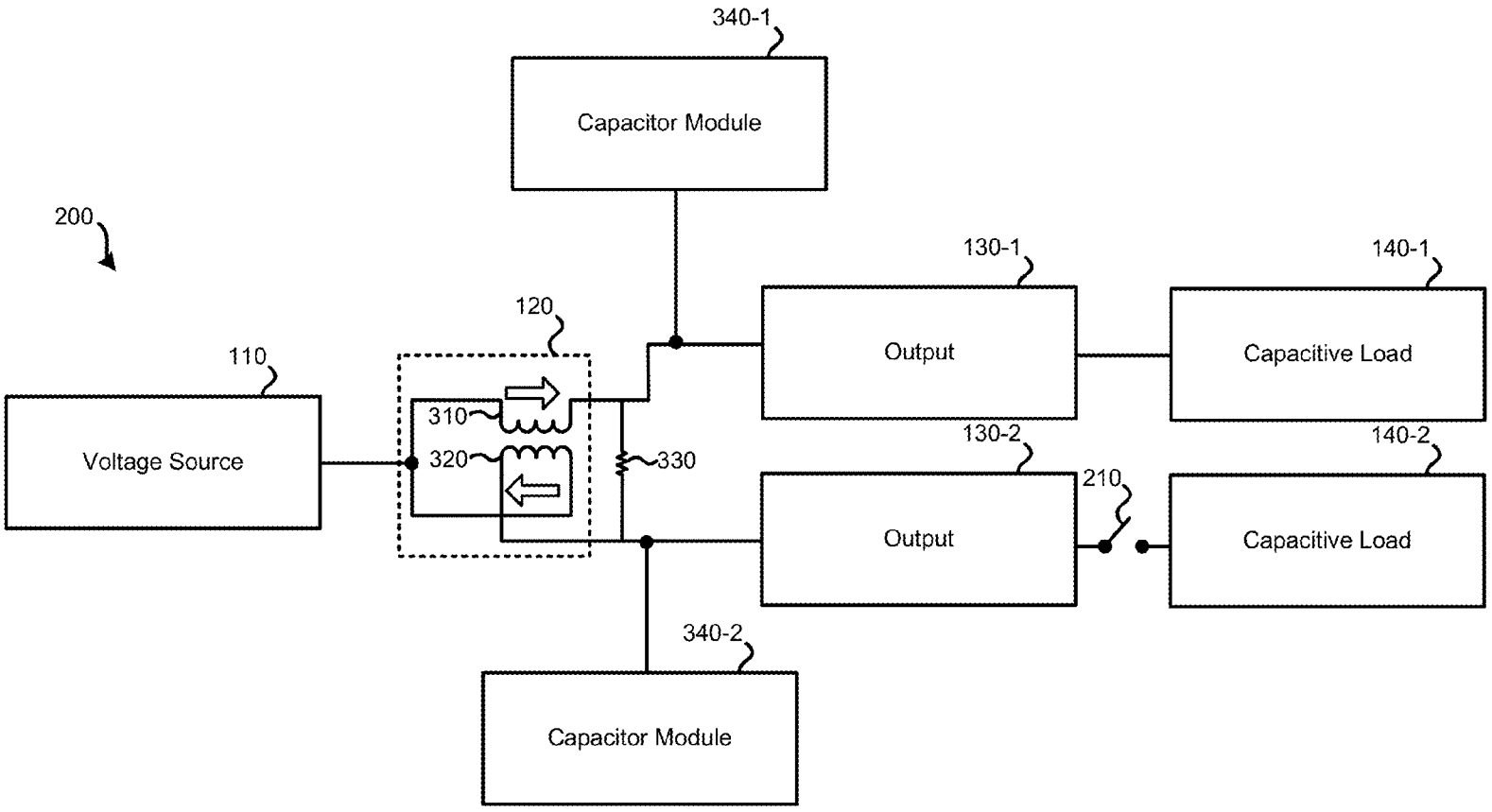
FIG. 3 illustrates a block diagram of an embodiment of a system for mitigating voltage droop in a direct current circuit configured to power multiple capacitive loads, in accordance with certain embodiments of the present disclosure.

FIG. 3 illustrates a block diagram of an embodiment of a system 300 for mitigating voltage droop in a direct current circuit configured to power multiple capacitive loads. System 300 may represent an embodiment of system 100 and/or system 200. In system 300, additional detail to transformer module 120 is illustrated. In system 300, transformer module 120 includes a dual winding transformer. In other embodiments, a tapped single winding transformer may be used.

Output 130-1 is electrically coupled with voltage source 110 via winding 310 of transformer module 120. Output 130-2 is electrically coupled with voltage source 110 via winding 320 of transformer module 120. As such, outputs 130 are electrically coupled with voltage source 110 via different windings of the same transformer. The direction of current flowing through winding 310 and winding 320 from voltage source 110 to capacitive loads 140 are illustrated by the dotted arrows. Due to the magnetic flux present within transformer module 120 caused by the current flowing to capacitive load 140-2 when switch 210 is closed, the current through winding 310 to capacitive load 140-1 may be affected such that 20 the voltage output to capacitive load 140-1 is greater than if transformer module 120 was not present.

If capacitive load 140-2 was connected with output 130-2 and switch 210 was instead present between capacitive load 140-1 and output 130-1, the magnetic flux created within transformer module 120 caused by the inrush current flowing to capacitive load 140-1 when switch 210 was closed (thus connecting capacitive load 140-1 with output 130-1), the voltage provided by winding 320 to capacitive load 140-2 may be greater than if transformer module 120 was not present. As such, regardless of whether capacitive load 140-1 or capacitive load 140-2 is first connected to voltage source 110 via transformer module 120, the voltage droop caused by initially connecting a second capacitive load will result in less voltage droop on the other capacitive load than if transformer module 120 was not present.

In system 300, resistor 330 may be present. In system 300, only one resistor (resistor 330) is illustrated; however, as those with skill in the art understand, a single resistor may be replaced with multiple resistors in parallel or in series. Resistor 330 may be connected between output 130-1 and output 130-2. Resistor 330 may be used to regulate the amount of voltage induced by winding 310 in winding 320 when capacitive load 140-1 is connected with output 130-1 and the amount of voltage induced by winding 320 in winding 310 when capacitive load 140-2 is connected with output 130-2. In some embodiments, it has been found that a resistance value for resistor 330 of approximately four times the supply impedance of voltage source 110 optimally mitigates voltage droop when a capacitive load is coupled with voltage source 110. In some embodiments, the transformer ratio is 1:1 while the impedance transformation ratio is 4:1.

System 300 may also include capacitor modules 340 (also referred to as a set of 10 capacitors). In system 300, a capacitor module is associated with each output of outputs 130. Each capacitor module may include one or more capacitors. While transformer module 120 may serve to decrease voltage droop on an output (e.g., output 130-1) when a capacitive load is initially connected with another output (e.g., output 130-2), some number of capacitors may be used to further decrease the amount of voltage droop experienced when a capacitive load is connected with an output. As such, capacitor modules 340 may be used together to decrease voltage droop. Each of capacitor modules 340 may provide less capacitance than would be necessary if transformer module 120 was absent. For example, in a typical USB power supply system, a minimum of 120 microfarads of capacitance on each output may be required to prevent voltage droop that exceeds USB specifications when a USB device is initially connected to the USB power supply. If system 300 is a USB power supply system, each of capacitor modules 340 may have less than 120 microfarads of capacitance because transformer module 120 assists in mitigating voltage droop. For example, each of capacitor modules 340 may have 110.1 microfarads capacitance. In other embodiments, capacitor modules 340 may each have 110 microfarads of capacitance, 100 microfarads of capacitance, 90 microfarads of capacitance, 80 microfarads of capacitance, or some other amount of capacitance. In some embodiments, transformer module 120 may be sufficient to decrease the amount of voltage droop such that capacitor modules 340 are not necessary.

Figure 4:
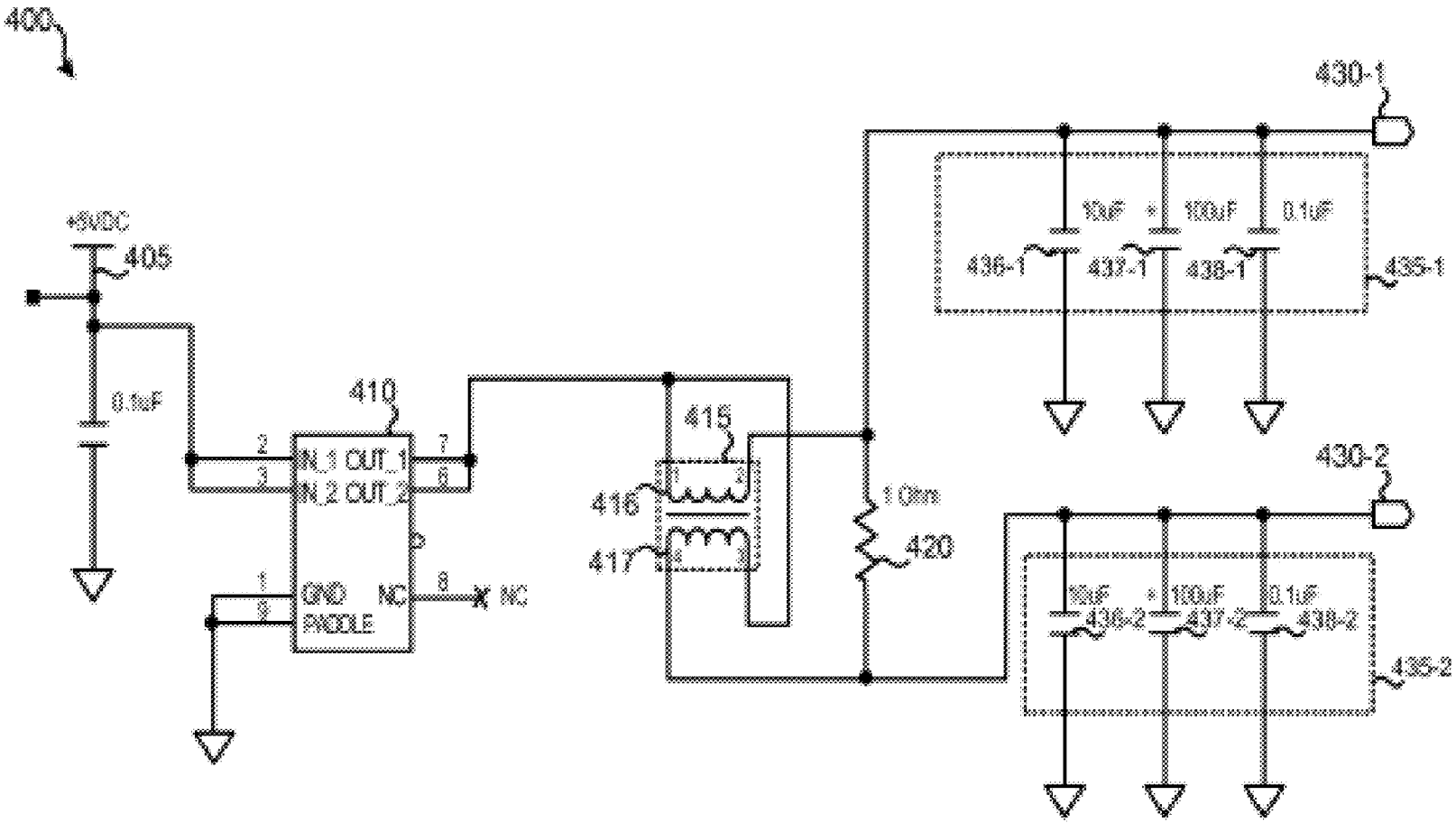
FIG. 4 illustrates a circuit diagram of an embodiment of a system for decreasing voltage droop in a USB power circuit configured to power multiple USB devices, in accordance with certain embodiments of the present disclosure.

FIG. 4 illustrates a circuit diagram of an embodiment of a system 400 for decreasing voltage droop in a USB power circuit configured to power multiple USB devices. System 400 may be implemented on a single circuit board or may be distributed across multiple circuit boards. System 400 represents at least a portion of a USB power circuit. It should be understood that similar systems may be used to decrease the amount of voltage droop for other types of direct current power circuits, particularly those in which a capacitive load may be initially connected while another device is being powered. System 400 may represent an embodiment of system 100, system 200, and/or system 300 of FIGS. 1-3, respectively.

Figure 10:
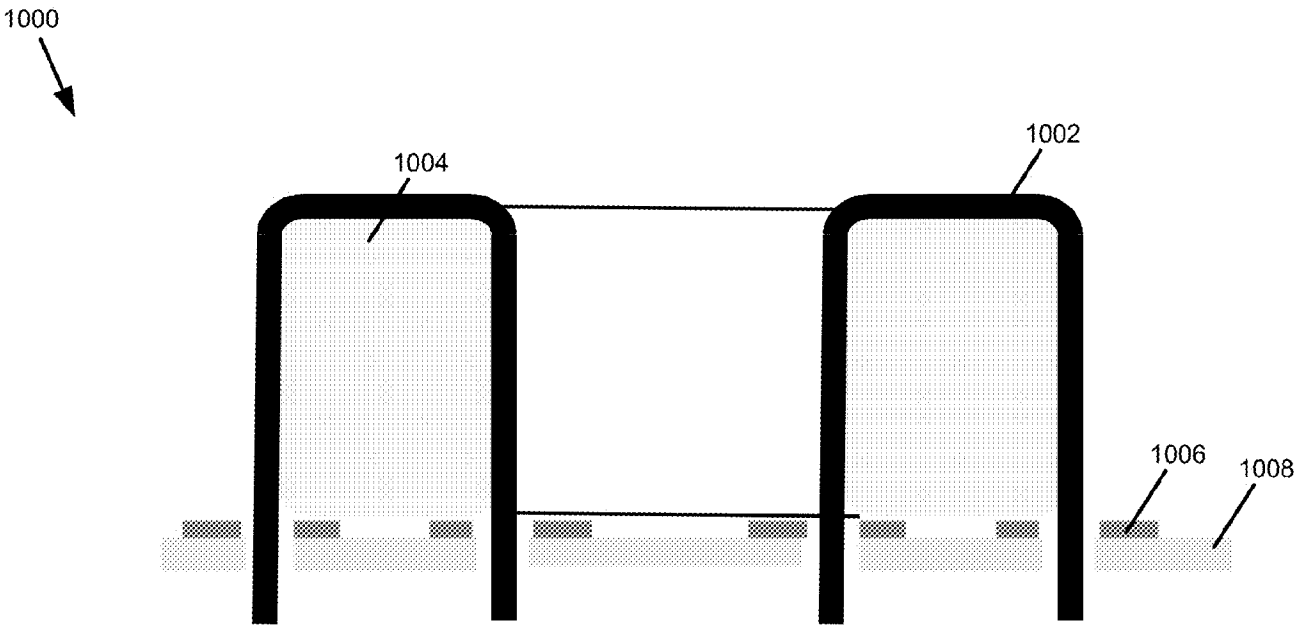
FIG. 10 shows a third example inductive element, in accordance with certain embodiments of the present disclosure.

System 400 may receive a DC voltage from an external source or may generate the DC voltage from another AC or DC voltage source. In system 400, voltage source 405 is a +5 V DC power source. Voltage source 405 may represent voltage source 110 of FIGS. 1-3. Power switch 410 may serve to regulate current drawn from voltage source 405. Power switch 410 may decouple voltage source 405 from transformer 415 when certain conditions are satisfied, such as an excess of current being drawn or a temperature has been exceeded. For example, MP6211DN manufactured by MPS may be used for power switch 410. In FIG. 10, voltage source 110 may represent both voltage source 405 and power switch 410.

Transformer 415 may represent transformer module 120 of FIGS. 1-3. Transformer 415 may be a dual-winding transformer having a 1:1 winding ratio. Transformer 415 may be wired such that current flows from terminal 1 to terminal 2 through winding 416, and that current flows from terminal 3 to terminal 4 through winding 417. As such, an increase in 15 current through either of winding 416 or winding 417 results in an increase in current and/or voltage through the other winding, as wired. For example, transformer 415 may be a TAIYO YUDEN CM04RC.

Resistor 420 may represent resistor 330 of FIG. 3. Resistor 420 may serve to regulate the amount of current and/or voltage induced by winding 416 and winding 417 in the other winding. The resistance of resistor 420 may be (at least approximately) four times the impedance of voltage source 405. Other values of resistor 420 may also be used. In some embodiments, a resistance of 1 Ohm is used for resistor 420. In FIG. 1, transformer module 120 may represent both transformer 415 and resistor 420.

Outputs 430 may be electrically coupled with resistor 420, transformer 415, power 25 switch 410, and voltage source 405. Outputs 430 may represent outputs 130 of FIGS. 1-3. If system 400 is a USB power supply circuit, outputs 430 may represent USB power output ports. Output 430-1 may be electrically connected with capacitor module 435-1, which includes capacitors 436-1, 437-1, and 438-1. Output 430-2 may be electrically connected with capacitor module 435-2, which includes capacitors 436-2, 437-2, and 438-2. Capacitors 436 may have a capacitance of 10 microfarads. Capacitors 43 7 may have a capacitance of 100 microfarads. Capacitors 438 may have a capacitance of 0.1 microfarads. As such, the total capacitance of each of capacitor modules 435 may be less than the minimum of 120 microfarads required for a USB power supply by some USB specifications. A USB device may be connected with each of outputs 430. For example, at a given time, USB device(s) may be connected with either output 430-1, output 430-2, both, or neither. In the instance of a USB device already being connected with output 430-1, and another USB device being connected with output 430-2, the USB device, due to its capacitance, may, upon connection with output 430-2, behave as a capacitive load, and thus draw an inrush current from voltage source 405 via power switch 410 and winding 417. The inrush current drawn by the USB device connected with output 430-1 may be supplied, at least in part, by: capacitor module 435-1 and voltage source 405. The draw of the inrush current by the USB device connected with output 430-2 may result in voltage droop on output 430-1. The amount of voltage droop experienced by output 430-1 may be decreased due to capacitor modules 435 and additional voltage and/or current being supplied by transformer 415 via winding 416 (due to the magnetic flux generated by the current flowing through winding 417). As such, voltage droop on output 430-1 is at least partially mitigated due to transformer 415 and capacitor modules 435.

In the instance of a USB device already being connected with output 430-2, and another USB device being connected with output 430-1, the reverse of the above paragraph may be true: the USB device, due to its capacitance, may, upon connection with output 430-1, behave as a capacitive load, and thus draw an inrush current from voltage source 405 via power switch 410 and winding 416 of transformer 415. The current drawn by the USB device already connected with output 430-2 may be supplied, at least in part, by: capacitor module 435-2 and voltage source 405. The draw of the inrush current by the USB connected with output 430-1 may result in voltage droop on output 430-2. The amount of voltage droop experienced by output 430-2 may be decreased due to capacitor modules 435 and additional voltage and/or current being supplied by transformer 415 via winding 417 (due to the magnetic flux generated by the current flowing through winding 416). As such, voltage droop on output 430-2 is at least partially mitigated due to transformer 415 and capacitor modules 435.

Figure 5:
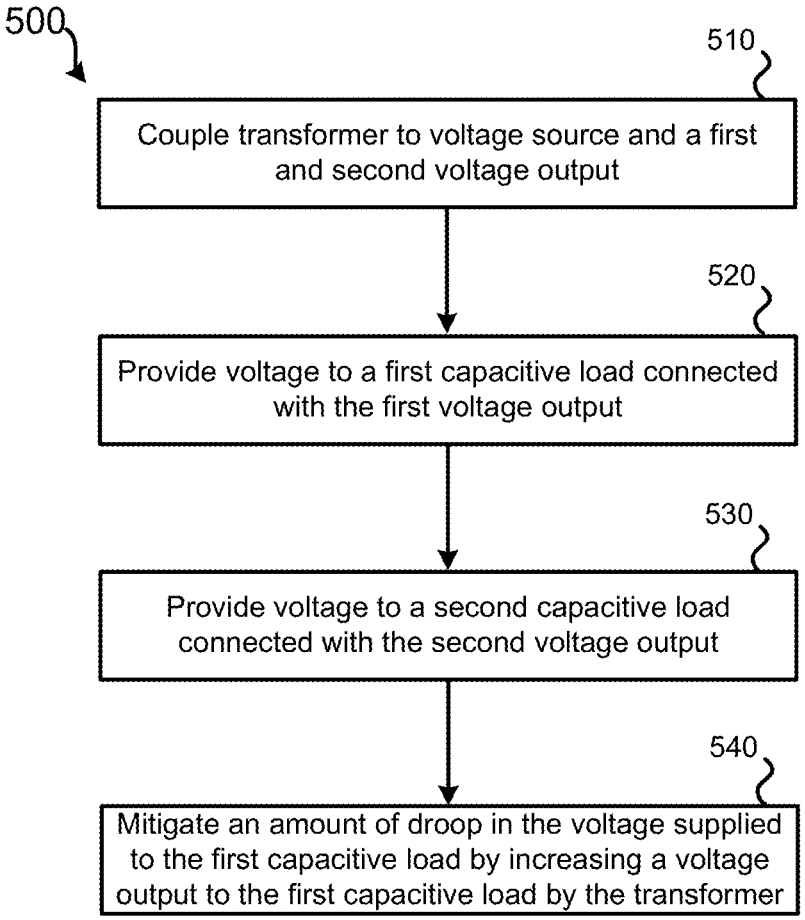
FIG. 5 illustrates an embodiment of a method for mitigating voltage droop in a direct current circuit configured to power multiple capacitive loads, in accordance with certain embodiments of the present disclosure.

Systems 100 through 400 of FIGS. 1-4, respectively, may be used to perform various methods to mitigate voltage droop in a direct current circuit. FIG. 5 illustrates an embodiment of a method for mitigating voltage droop in a direct current circuit configured to power multiple capacitive loads. Method 500 may be performed using one of systems 100 through 400 of FIGS. 1-4, respectively. Method 500 may also be performed using a different system configured for mitigating voltage droop in a DC circuit that is configured to power multiple capacitive loads. Means for performing each step of method 500 include systems 100 through 400 and their respective components.

At step 510, a transformer may be electrically coupled with a direct current voltage source and a first and second output. The transformer may be electrically coupled with the voltage source through one or more additional components. For example, referring to system 400 of FIG. 4, transformer 415 is electrically coupled with voltage source 405 via power switch 410. The transformer used at step 510 may be a tapped single winding transformer or a dual winding transformer. The transformer may have a winding ratio of 1:1. For a dual winding transformer, the transformer may have each winding electrically coupled with the voltage source and each winding may be electrically coupled with an output. As illustrated in FIGS. 3 and 4, the transformer may be coupled with the voltage source such that current drawn by a capacitive load placed on an output through the windings of the transformer flow in opposite directions. As such, an increased current to one output will cause an increase in voltage to the other output.

At step 520, an output DC voltage may be provided to a first capacitive load connected with the first voltage output. This first capacitive load may use the received voltage as a power source. At this time, no capacitive load may be connected with the second output. As such, the voltage source may currently only be used for powering the first capacitive load connected with the first voltage output. At step 530, a second capacitive load may be connected with the second output. The voltage source may supply this second capacitive load with a voltage (and thus current) to power the second capacitive load. Due to the voltage source not being ideal, it may not be able to provide a perfect steady-state DC voltage to the first capacitive load when the second capacitive load is connected due to the amount of initial inrush current being drawn by the second capacitive load. The first capacitive load may experience voltage droop on the first output due to the inrush current being drawn by the second capacitive load via the second output.

At step 540, the amount of droop in voltage output to the first capacitive load via the first output may be at least partially mitigated. The voltage droop may be mitigated by the transformer being induced by magnetic flux from the current through the second winding to the second output to output a greater voltage to the first output. As such, due to the transformer, the amount of voltage droop experienced by the first output connected with the first capacitive load is less than if the transformer was not electrically coupled with the circuit at step 510. Following the initial inrush current to the second capacitive load subsiding (e.g., the capacitive load becoming charged), the voltage supply may provide each of the first and second outputs with a steady state DC voltage at approximately the voltage output by the voltage source. At some future time, if one of the capacitive loads is disconnected and the 5 same or a different capacitive load is reconnected, method 500 may repeat.

Figure 6:
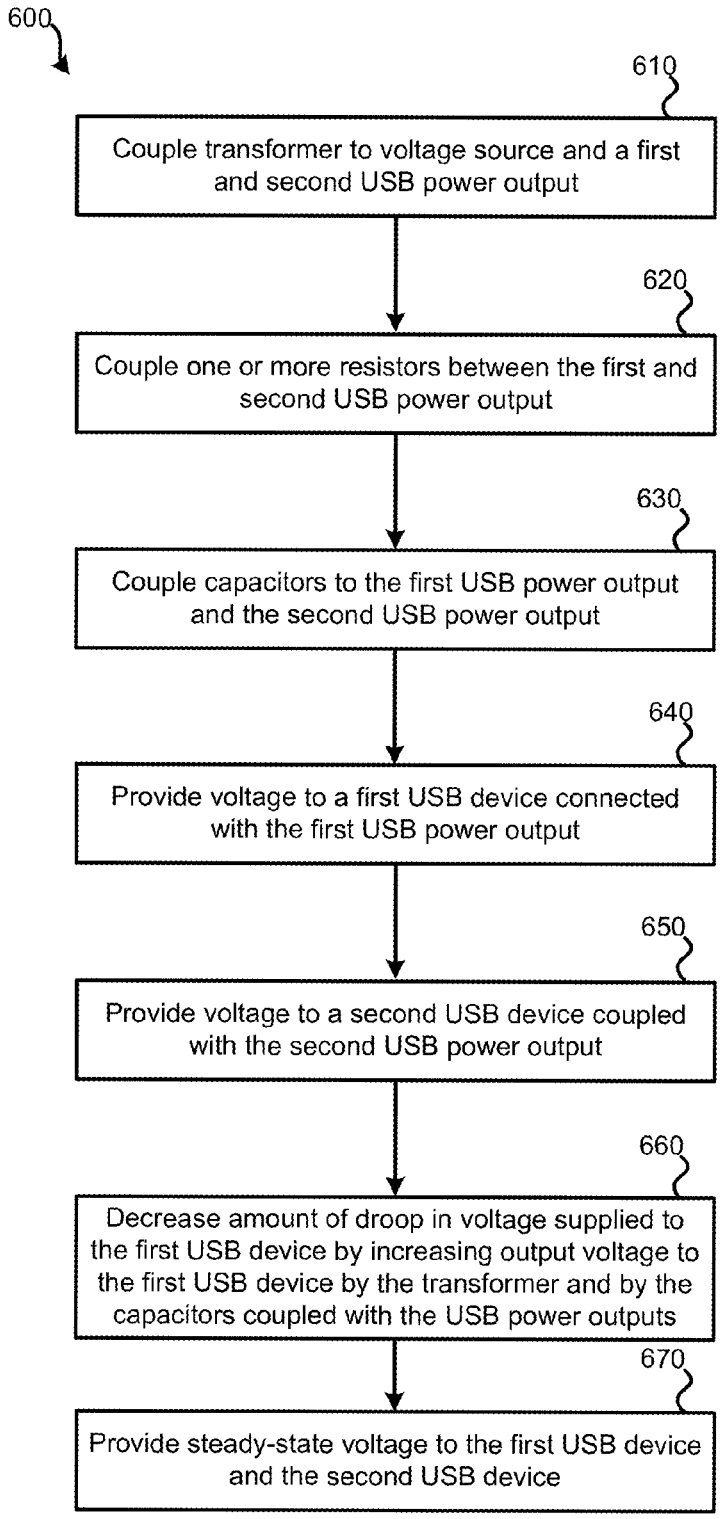
FIG. 6 illustrates an embodiment of a method for decreasing voltage droop in a USB power circuit configured to power multiple USB devices, in accordance with certain embodiments of the present disclosure.

FIG. 6 illustrates an embodiment of a method 600 for decreasing voltage droop in a USB power circuit configured to power multiple USB devices. Method 600 may be performed using one of systems 100 through 400 of FIGS. 1-4, respectively. Method 600 may also be performed using a different system configured for mitigating voltage droop in a DC circuit that is configured to power multiple capacitive loads. Method 600 may represent an alternative embodiment of method 500. Means for performing each step of method 600 include systems 100 through 400 and their respective components.

At step 610, a transformer may be electrically coupled with a direct current voltage source and a first USB power output and a second USB power output. The transformer may 15 be electrically coupled with the voltage source through one or more additional components. For example, referring to system 400 of FIG. 4, transformer 415 is electrically coupled with voltage source 405 via power switch 410. The transformer used at step 510 may be a tapped single winding transformer or a dual winding transformer. The transformer may have a winding ratio of 1:1. For a dual winding transformer, the transformer may have each winding electrically coupled with the voltage source and each winding may be electrically coupled with an output. As illustrated in FIGS. 3 and 4, the transformer may be coupled with the voltage source such that current drawn by a capacitive load placed on an output through the windings of the transformer flow in opposite directions.

At step 620, one or more resistors may be electrically coupled between the first output and the second output. These one or more resistors may be used to control the amount of voltage and/or current inducted by the transformer on one USB power output when a capacitive load draws an inrush current on the other USB power output. In some embodiments, the one or more resistors may have a resistance of (approximately) four times the impedance of the voltage source. In some embodiments, the voltage source impedance 30 may be 0.25 Ohms, thus the resistance of the resistor(s) may be 1 Ohm.

At step 630, one or more capacitors may be coupled with each of the first and second USB power outputs. Such capacitors may be used together with the transformer to mitigate voltage droop when the second USB device is connected with the second USB power output. According to USB specifications, at least 120 microfarads of capacitance is required to be coupled with each USB power output so that no more than 330 mV of voltage droop is experienced on a USB power output when a USB device (which is acting as a capacitive load) is connected with another USB power output that is electrically coupled with the same voltage source. However, due to the transformer, it may be possible to use capacitors that have less than a total of 120 microfarads of capacitance while achieving less than a maximum of 330 mV of voltage droop on a USB power output when a USB device is connected with another USB power output connected with the same voltage source. In some embodiments, 110 microfarads of capacitance may be electrically coupled with each USB power output. Such capacitance may be in the form of: one 100 microfarad capacitor, one 10 microfarad capacitor, and one 0.1 microfarads capacitor. At step 640, an output DC voltage of +5 V may be provided to a first USB device connected with the first USB power output. This USB device may use the received 5 V DC as a power source. At this time, no USB device may be connected with the second USB power output. As such, the voltage source may currently only be used for powering the first USB device connected with the first USB power output. At step 650, a second USB device may be connected with the second USB power output. The voltage source may attempt to supply this second USB device with a +5 V DC voltage. Due to the voltage source not being ideal, it may not be able to provide a perfect steady-state DC voltage to the first USB device when the second USB device is initially connected to the second USB power output due to the amount of inrush current being drawn by the second USB device, which is acting as a capacitive load. As such, the first USB device may experience voltage droop on the first USB power output due to the current being drawn by the second USB device via the second output.

At step 660, the amount of droop in voltage output to the first USB device via the first USB power output may be at least partially mitigated. The voltage droop may be mitigated by the transformer being induced by the current through the second winding to the second USB power output to output a greater voltage to the first USB power output. As such, due to the transformer, the amount of voltage droop experienced by the first USB power output connected with the first USB device is less than if the transformer was not electrically coupled with the circuit at step 610.

Further, at step 660, the voltage droop to the first USB device may be further mitigated by capacitors being present on the first and second USB power outputs. Current drawn by the second USB device may at least partially supplied by the capacitors coupled with the second USB power output thus decreasing the amount of current drawn by the second USB device through the transformer from the voltage supply. Capacitors coupled with the first USB power output may also help mitigate voltage droop to the first USB device. As such, the capacitors may work in combination with the transformer to mitigate voltage droop output by the first USB power output to the first USB device.

At step 670, following the initial inrush current to the second USB device subsiding (e.g., the capacitors of the second USB device becoming charged), the voltage supply may provide the first and second outputs with a steady state +5 V DC. At some future time, if one of the capacitive loads is disconnected and the same or a different capacitive load is reconnected, method 600 may repeat. It should be understood that if the first USB device is disconnected from the first USB power output and the first USB device (or another USB device) is then (re)connected to the first USB power output, references to the "first" and "second" in steps 640 through 660 would be reversed.

The following section may be related to the preceding discussion in that the following provides methods for manufacturing passive inductive elements and related devices. Such manufacturing methods may result in economic savings over conventional arrangements.

In one embodiment, half-turns of an inductive winding may be formed by stamping or cutting winding segments from a conductive sheet. The winding segments may be positioned adjacent each other and to a core element to form a first part. The first part may be mounted to a printed circuit board (PCB) or printed wiring board (PWB), using conductive traces of the PCB/PWB to complete the inductive winding.

Some benefits and/or advantages associated with such a procedure may include: simplify manufacture of inductive windings; remove requirement for a complex winding machine; multiple turns/windings may be formed in single automated operation; no preforming of winding ends; terminations may be automatically formed from single pressing operation; attachment to fixed terminations may not be required due to mechanical rigidity of sheet material; windings may provide mechanical support due to larger cross sectional area compared with circular wire windings; applicable to both surface mount and through-hole mounting. Still other benefits and/or advantages are possible as well.

Some example applications may include: PCB/PWB surface mounted inductors and transformers; DC/DC converters; isolating transformers (e.g., Ethernet applications; asymmetric digital subscriber line applications, etc.); RF transformers/baluns, and/or others such as described above in connection with FIGS. 1-6.

Referring now to FIGS. 7-13, methods for forming of sheet formed inductive winding are discussed in accordance with certain embodiments of the present disclosure.

Figure 7:
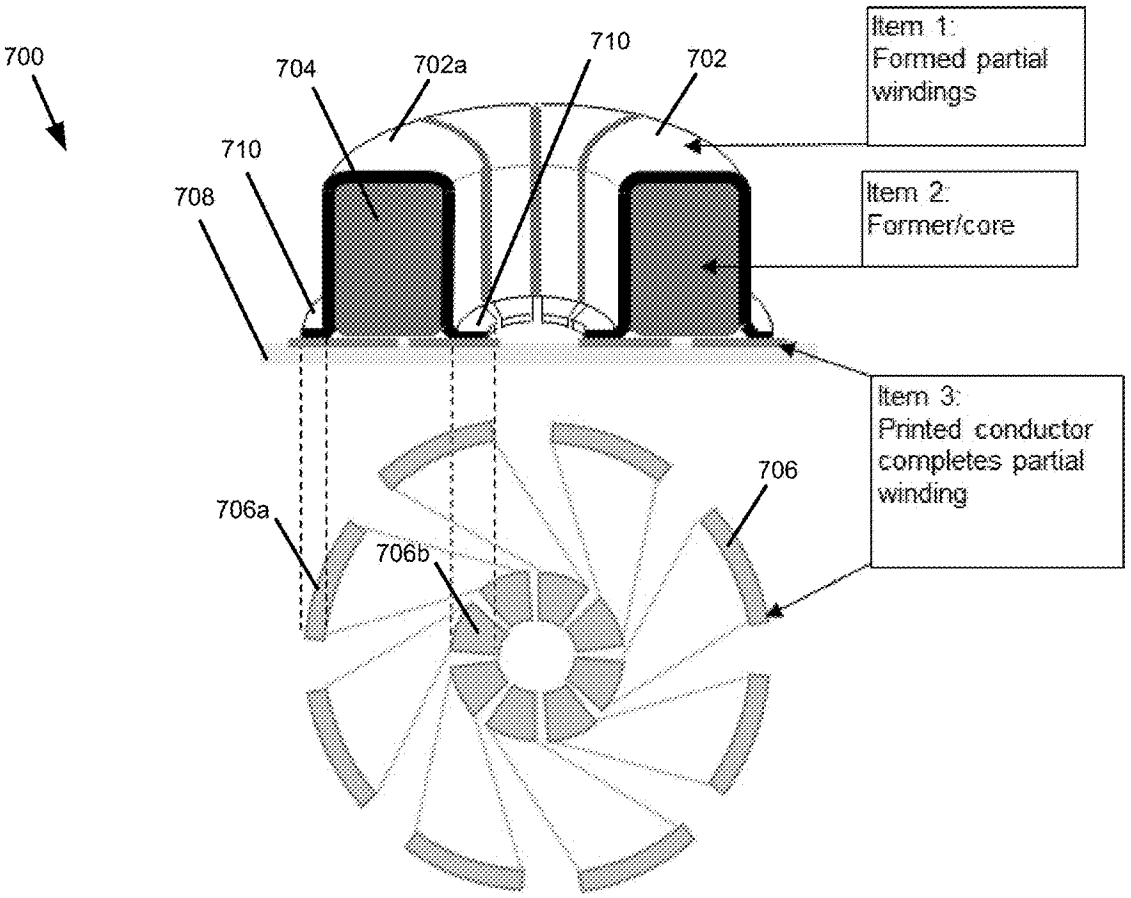
FIG. 7 shows a first example inductive element, in accordance with certain embodiments of the present disclosure.
Figure 8A:
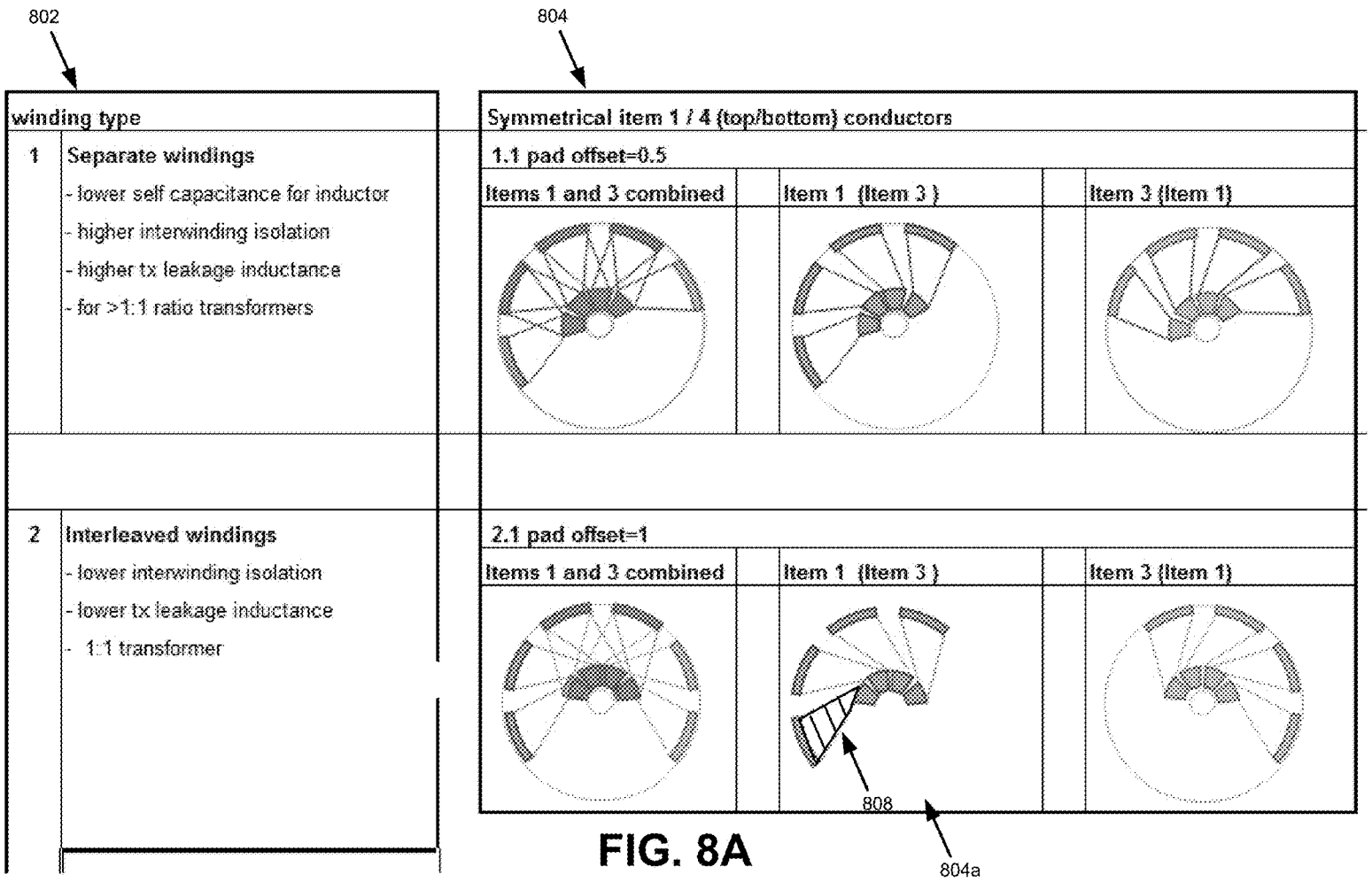
FIGS. 8A and 8B show multiple inductive winding configurations, in accordance with certain embodiments of the present disclosure.
Figure 8B:
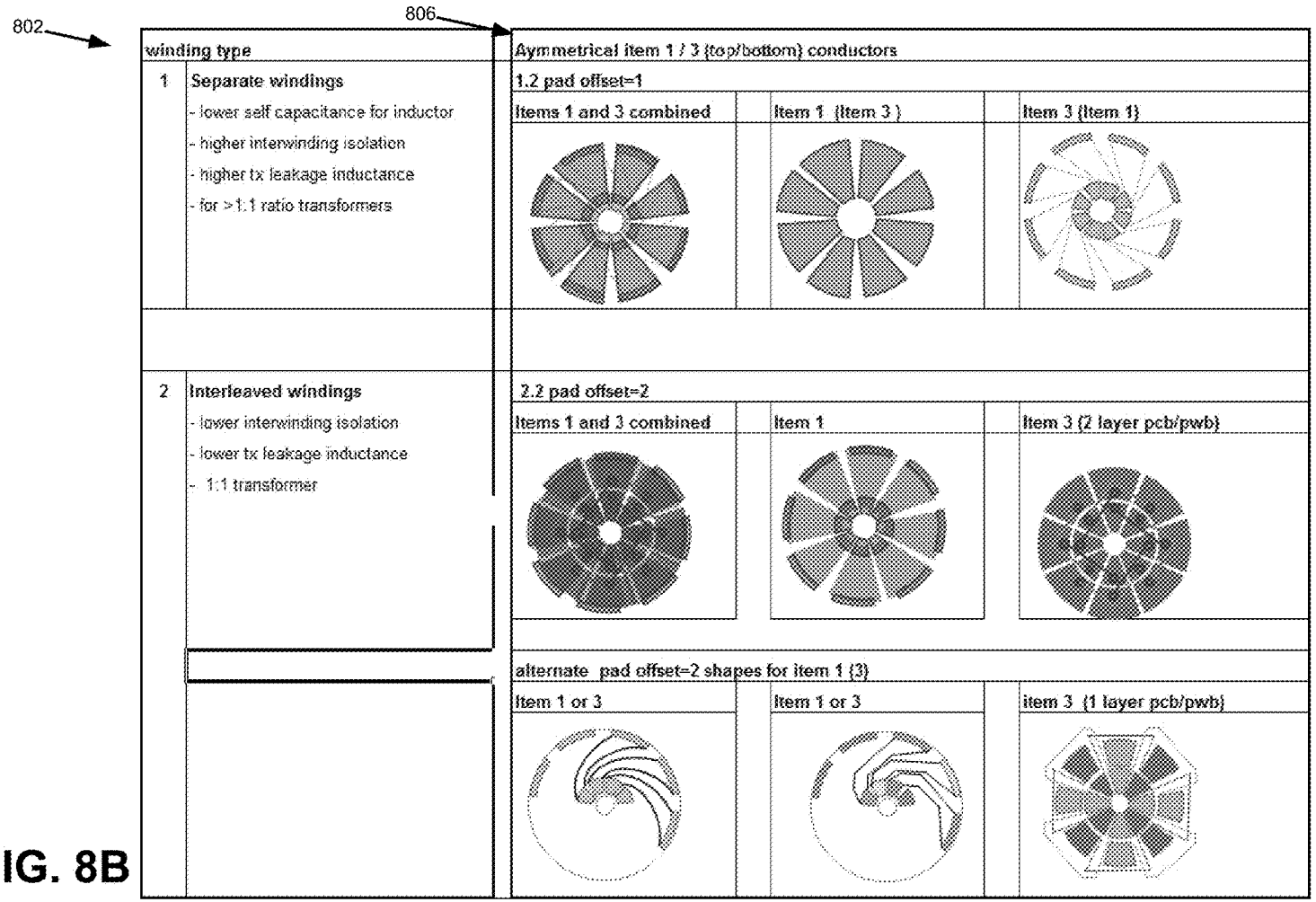

FIG. 7 shows a first example inductive element 700 in accordance with certain embodiments of the present disclosure. Inductive element 700 may be suitable for low-cost and high-volume manufacturing processes and, as an example, inductive element 700 is shaped as a toroid with 8 turns and a maximum dimension of about 6 mm, thereby conforming to 0402 component PCB/PWB solder pad size. Other embodiments are possible, such as with greater or fewer numbers of turns and larger or smaller maximum dimension.

Inductive element 700 may include: multiple partial windings 702; core and/or supporting former 704; and printed conductor 706. Inductive element 700 may be mounted to substrate 708. In one embodiment, substrate 708 may correspond to a PCB/PWB.

Multiple partial windings 702 may be present in inductive element 700. Each respective partial winding does not connect directly with other partial windings. Rather, connection between each of the partial windings, to form a complete winding occurs via multiple printed conductors, such as printed conductor 706. Multiple partial windings may be "part turns" fabricated (e.g., etched or cut and then punched) from a sheet of malleable conductive material, such as tin-plated steel/copper. Other embodiments are possible.

Core 704 may be present in inductive element 700. Multiple partial windings 702 may be positioned relative to core 704. Multiple partial windings 702 are not in electrical contact with each other along core 704 (when not coupled to multiple printed conductors, such as printed conductor 706). Core 704 may be a "former" that adds or further introduces mechanical support to inductive element 700. Core 704 may exhibit magnetic properties to increase inductance of inductive element 700. Shape of core 704 is not restricted to a toroid. In some embodiments, core 704 may be omitted. In the illustrated embodiment, inductive element 700 may be "air-cored."

Printed conductors 706 may be present in inductive element 700. Printed conductors 706 may correspond to a trace within/on substrate 708. In FIG. 7, eight printed conductors are shown. As shown in FIG. 7, multiple partial windings 702 may be coupled (e.g., surface mount, flow solder, etc.) to particular portions of printed conductor 706 by tabs 710 to "complete the circuit," forming a continuous winding of inductive element 700. Preformed tabs 710 (which may be formed before mounting to substrate 708 by "stamping," for example) may provide for rigid terminations to substrate 708 when compared to traditional small diameter wire terminations, which may be more delicate and thus harder to efficiently attach to a substrate in a manufacturing environment. When a particular partial winding is mounted to substrate 708, the partial winding may be attached to two printed conductors. For example, partial winding 702*a* may be attached to printed conductor 706*a* and printed conductor 706*b*. At least one other partial winding may be attached to each of printed conductors 706, thus electrically connecting the partial windings to create a full winding. Effectively, each printed conductor, such as printed conductor 706*a*, when coupled with the partial windings, serves as part of the created continuous winding.

Multiple partial windings 702 and printed conductor 706 may be arranged together in a number of different configurations to form a continuous winding of inductive element 700. For example, referring now to additionally FIGS. 8A and 8B, multiple inductive winding configurations are shown in accordance with the present disclosure. In particular, winding types may include: separate windings; interleaved windings. Separate windings and interleaved windings may each have particular properties, such as listed at least partially in section 802 of FIGS. 8A and 8B.

It is contemplated that separate windings, and interleaved windings, may be arranged in a symmetric or asymmetric configuration as desired, such as listed at least partially in section 804 and section 806. In one or more of the examples of section 804 and 806, pad layout is not fully conveyed. For example, in 804*a*, contact pads 808 should be shown as "filled-in" to represent a continuous metallic thin film, illustrated by "cross-hatching" in 804*a*.

Electrical properties of an inductive element having a symmetric winding layout may be slightly different than electrical properties of an inductive element having an asymmetric winding layout. For example, parasitic capacitance and/or inductance of an inductive element having a symmetric winding layout may be slightly different than an inductive element having an asymmetric layout. Additionally, winding layout may affect heat dissipation, component cross-talk, and other issues associated with integrated circuits as well.

Figure 9:
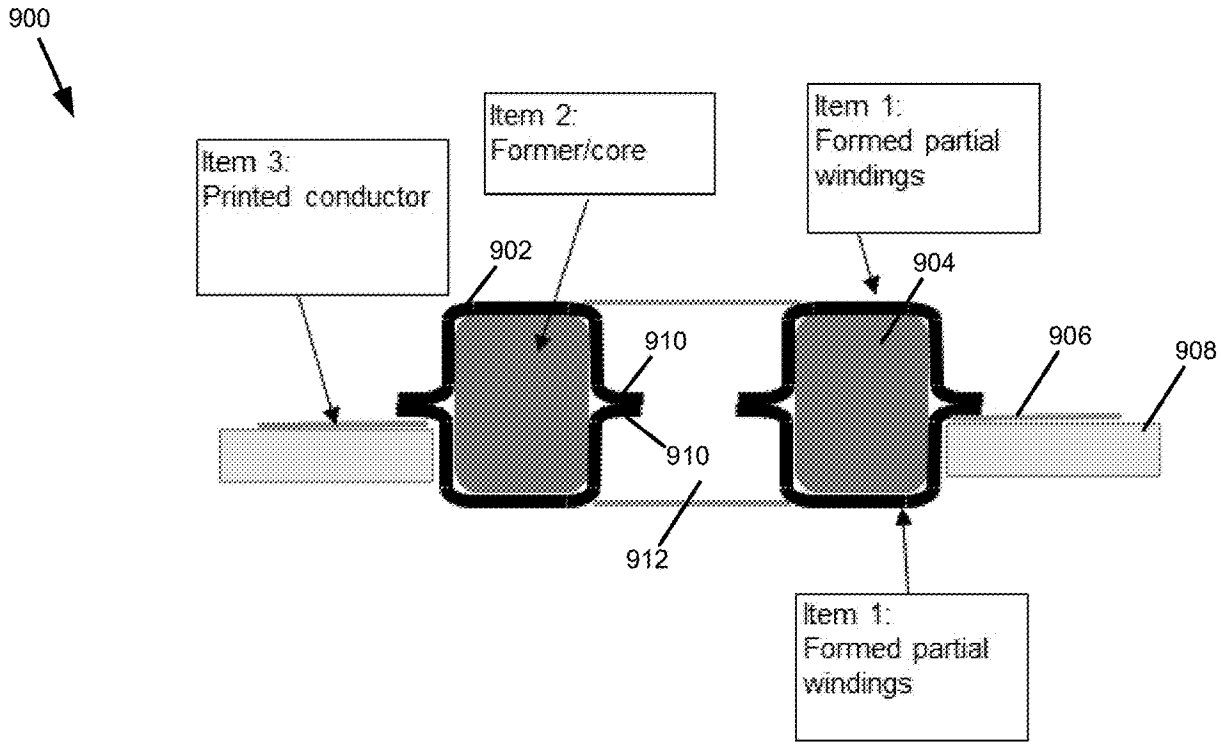
FIG. 9 shows a second example inductive element, in accordance with certain embodiments of the present disclosure.

FIG. 9 shows a second example inductive element 900 in accordance with certain embodiments of the present disclosure. Inductive element 900 may be suitable for low cost and high volume manufacturing processes. Inductive element 900 may be similar to inductive element 700 of FIG. 7. For example, inductive element 900 may include: multiple partial windings 902; core 904; and printed conductor 906. Inductive element 900 may be mounted to substrate 908. Multiple partial windings 902 may include tabs 910. At least a portion of inductive element 900 may be embedded within well 912 of substrate 908. FIG. 9 therefore illustrates one example method for reducing the profile of an inductive element formed in accordance with the present disclosure. Such an arrangement may be useful if limited space above substrate 908 is available.

FIG. 10 shows a third example inductive element 1000 in accordance with certain embodiments of the present disclosure. Inductive element 1000 may be suitable for low-cost and high-volume manufacturing processes. Inductive element 1000 may be similar to inductive element 700 of FIG. 7, and inductive element 900 of FIG. 9. For example, inductive element 1000 may include: multiple partial windings 1002; core 1004; and printed conductor 1006. Inductive element 1000 may be mounted to substrate 1008. However, inductive element 1000 is mounted to substrate 1008 in accordance with a single-sided "through-hole" board mounting technique. As in other described embodiments, multiple partial winds of inductive element 1000 may be electrically connected with multiple printed conductors 1006 on substrate 1008, thus effectively creating a continuous winding around core 1004. FIG. 10 therefore illustrates one example method for providing a possible stronger mechanical bonding of an inductive element formed in accordance with certain embodiments of the present disclosure with a substrate.

Figure 11:
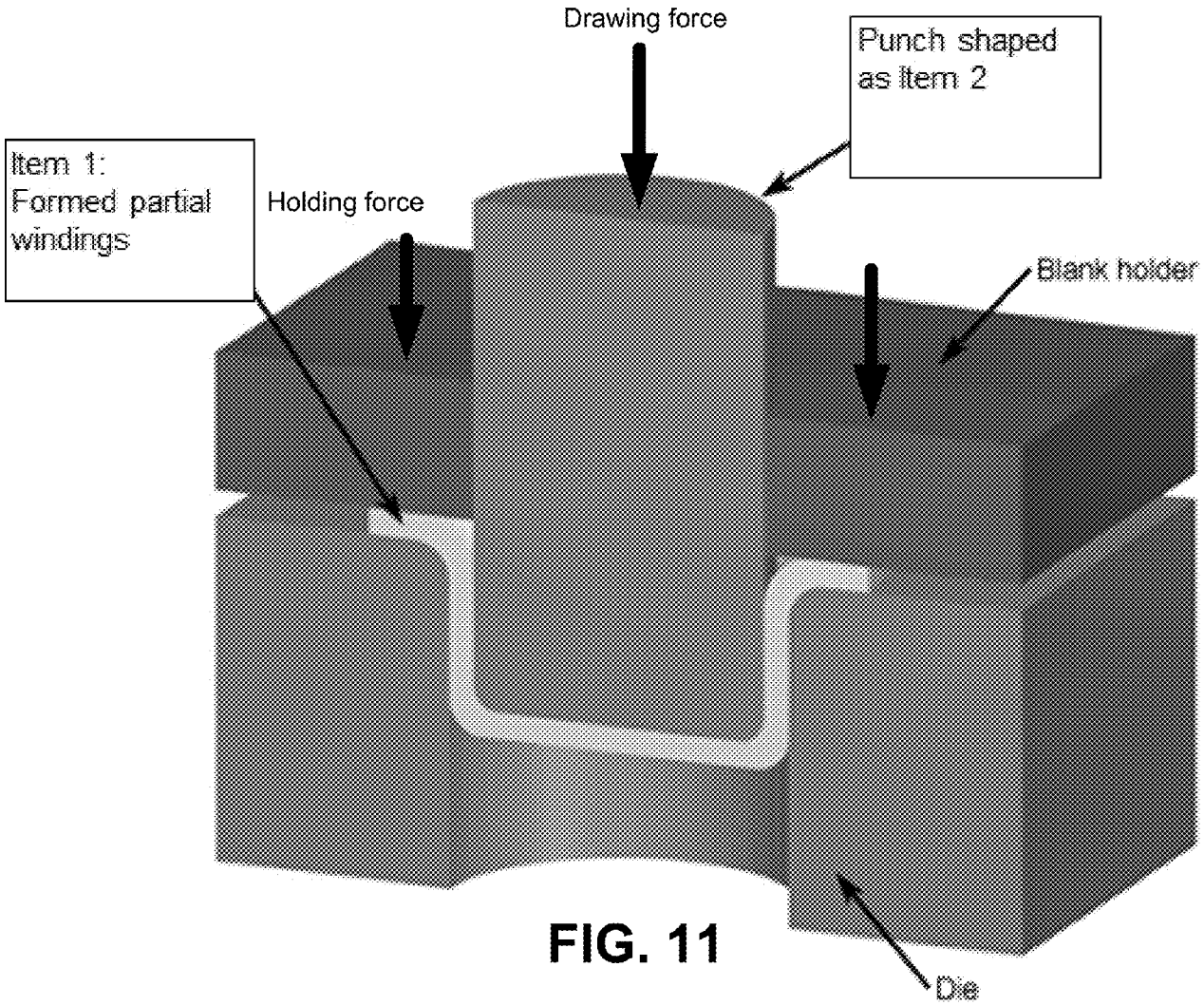
FIG. 11 shows a die/punch method of forming multiple partial windings, in accordance with certain embodiments of the present disclosure.

FIG. 11 shows a die/punch method of forming multiple partial windings (e.g., multiple partial windings 702) in accordance with certain embodiments of the present disclosure. Multiple of the partial windings, such as eight, may be arranged around a core and may be electrically connected with printed conductors to form a complete winding around a core.

Figure 12A:
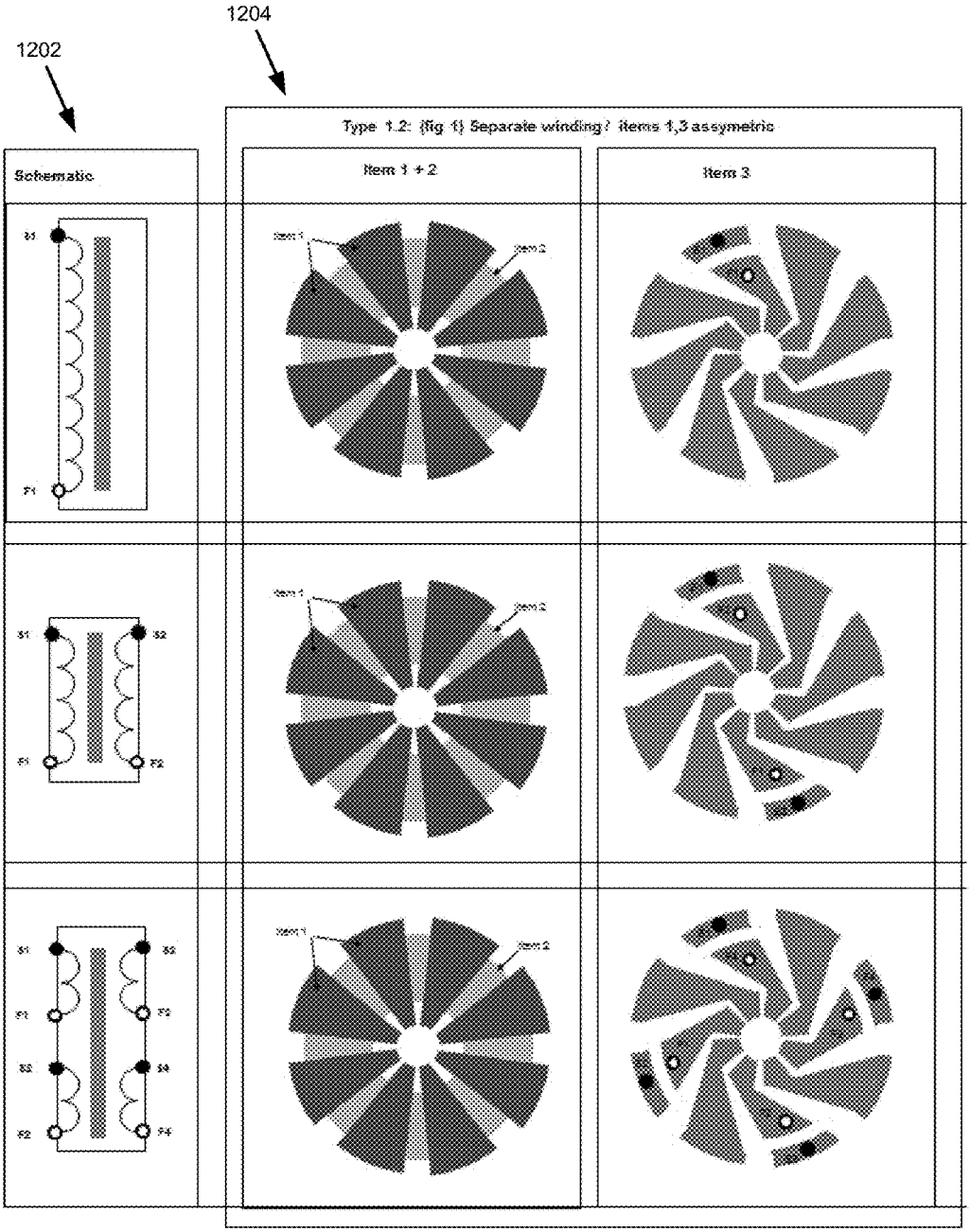
FIGS. 12A and 12B show various inductive elements and terminations, in accordance with certain embodiments of the present disclosure.
Figure 12B:
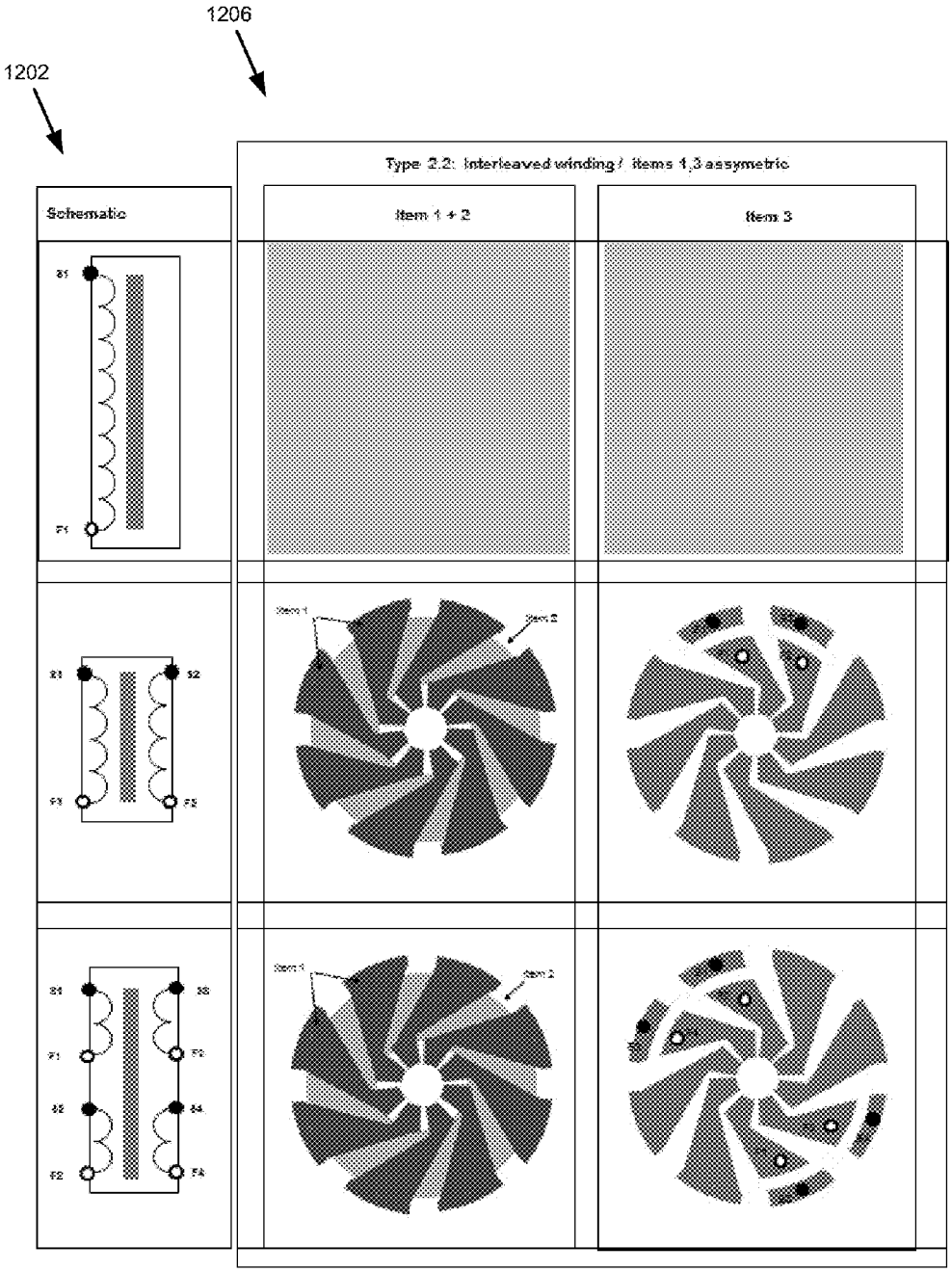

FIGS. 12A and 12B show various inductive elements and terminations in accordance with certain embodiments of the present disclosure. In particular, various inductive elements may include: inductors; and transformers. It should be understood that the embodiments detailed herein may be considered dedicated components. For example, a dedicated inductor may be a component added to a circuit primarily for the purpose of adding inductance to a circuit. A dedicated transformer may be a component added to a circuit primarily for the purpose of transferring energy via inductive coupling between winding circuits of the transformer. Section 1202 shows at least a partial list of inductive elements. Terminations may be defined in accordance with winding type and/or winding configuration. Winding type may include: separate; and interleaved. Winding configuration may include: symmetric; and asymmetric. Winding type and configuration is described further above in connection with FIGS. 8A and 8B. Sections 1204 and 1206 show at least a partial list of winding type and configuration. Terminations may be used to connect the inductive element to other components present on the substrate, such as via conductive traces. As illustrated in FIGS. 12A and 12B, depending on the type of inductive element to be created, two or more terminals may be present. An inductor may have two terminals, while a transformer may have more than two terminals, such as three, four, or eight. A transformer may have multiple windings around a core. Examples of inductive elements with two, four, and eight terminals are illustrated in FIGS. 12A and 12B.

Figure 13:
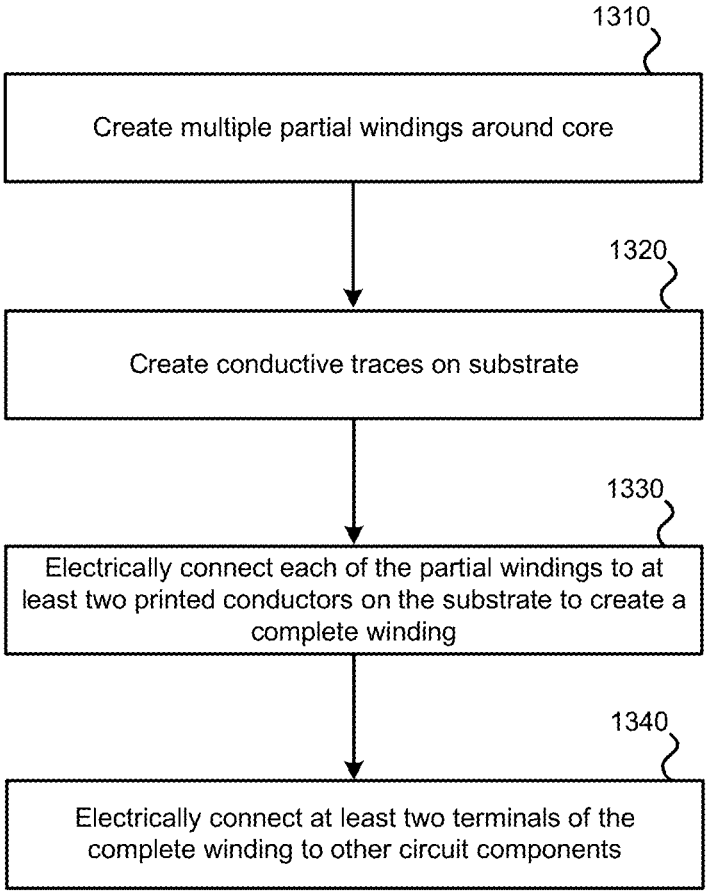
FIG. 13 illustrates a method for creating an inductive element, in accordance with certain embodiments of the present disclosure.

FIG. 13 illustrates a method for creating an inductive element in accordance with certain embodiments of the present disclosure, such as those previously described herein. At step 1310, multiple partial windings may be created and arranged around a core (which may be a solid substance or air). Each of the partial windings may have two terminals. At this point of manufacture, each partial winding may be disconnected from each other winding. In some embodiments, an arrangement as shown in FIG. 11 may be used to create each partial winding.

At step 1320, multiple printed conductors may be printed (or other placed) onto a substrate. Such printed conductors may be created during a typical PCB printing process, similar to creation of pads and traces. If necessary, required vias and/or trace connectors on the same or different layers of the PCB may also be created. At this step, each of these printed conductors may be separated from each other. Each of the multiple printed conductors may be configured to be electrically connected with at least two partial windings.

At step 1330, the multiple partial windings may be connected with the multiple printed conductors. Each partial winding may be connected with two printed conductors and each printed conductor may be connected with two partial windings, thus creating an electrically continuous winding around the core. At least two terminals may also be created, thus allowing a voltage/current (an input electrical signal) to be input to the inductive element and a voltage/current (an output electrical signal) to be output from the inductive element. The complete winding may allow the input electrical signal to be passed around the core multiple times via the complete winding and output as the output electrical signal. A complete winding around the core may only be present after the partial windings have been electrical connected (e.g., soldered) to the printed conductor.

At step 1340, at least two terminals of the complete winding may be connected with other circuit components. As such, an input electrical signal may be received by the inductive element and an output electrical signal may be output by the inductive element.

It should be noted that the methods, systems, and circuits discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention. Specific details are given in the description to provide a thorough understanding of the embodiments. However, it will be understood by one of ordinary skill in the art that the embodiments may be practiced without these specific details. For example, well-known circuits, structures, and techniques have been shown without unnecessary detail in order to avoid obscuring the embodiments.

This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention. Further, the preceding description focuses on USB power circuits; however, it should be understood that various embodiments described herein may be adapted to mitigate voltage droop for other forms of DC circuits where a capacitive load may be electrically coupled with a voltage supply while the voltage supply is providing a voltage to another output.

Also, it is noted that the embodiments may be described as a method which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, embodiments of the methods may be implemented by hardware, firmware, or any combination thereof. Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

What is claimed is:

1. A method for forming an inductive element, the method comprising:

creating a well in a substrate sufficient to depress a core at least partially in the substrate;

disposing multiple partial windings at least partially about the core such that the multiple partial windings are electrically disconnected, wherein the multiple partial windings comprise a first subset of the multiple partial windings and a second subset of the multiple partial windings, and the disposing comprises:

arranging the first subset about the core on a first side of the core that is to be disposed at least partially in the well in the substrate;

arranging the second subset about the core on a second side of the core that is opposite of the first side of the core and is to be disposed outside of the well in the substrate;

wherein the first subset is disposed to support the core when the core is disposed at least partially in the well in the substrate;

attaching the first subset to the substrate within the well such that the core is at least partially in the substrate and supported on the first side of the core by the first subset of the multiple partial windings;

arranging multiple conductors coupled to the substrate to electrically connect the multiple partial windings; and electrically connecting the multiple partial windings to the multiple conductors to form an electrically continuous winding about the core.

2. The method of claim 1, further comprising:

forming two tabs for each partial winding of the multiple partial windings;

wherein electrically connecting the multiple partial windings to the multiple conductors to form the electrically continuous winding about the core comprises attaching the two tabs of each partial winding of the multiple partial windings to different conductors of the multiple conductors.

3. The method of claim 1, further comprising: creating the well in the substrate sufficient to depress the core a distance into the substrate; and attaching the core to the substrate within the well such that the core is depressed the distance into the substrate.

4. The method of claim 1, wherein the multiple conductors are printed conductors.

5. The method of claim 1, further comprising:

forming at least two terminals for the inductive element; and coupling the at least two terminals with other components.

6. The method of claim 5, wherein the inductive element is a dedicated inductor component having two terminals.

7. The method of claim 5, wherein the inductive element is a dedicated transformer component having three or more terminals.

8. The method of claim 1, further comprising:

attaching the core to the substrate.

9. The method of claim 8, wherein the core is toroidal.

10. The method of claim 1, further comprising:

forming the multiple partial windings from a sheet of malleable conductive material.

11. The method of claim 10, wherein the multiple partial windings are formed at least in part with the core so that the core adds or introduces mechanical support to the inductive element.

* * * * *